United States Patent [19]

Sarka

[11] Patent Number: 4,561,334

[45] Date of Patent: Dec. 31, 1985

[54] ROTARY STRIPPER

[75] Inventor: Albert J. Sarka, West Bloomfield, Mich.

[73] Assignee: Bernal Rotary Systems, Inc., Troy, Mich.

[21] Appl. No.: 622,078

[22] Filed: Jun. 19, 1984

[51] Int. Cl.[4] ..... B26D 7/18

[52] U.S. Cl. ..... 83/27; 83/103; 493/342; 493/373

[58] Field of Search ..... 83/103, 27; 493/342, 493/373; 225/97

[56] References Cited

U.S. PATENT DOCUMENTS

| | | | |
|---|---|---|---|
| 1,290,301 | 1/1919 | Novick | 83/103 |
| 1,487,661 | 3/1924 | Langston | 83/103 |
| 3,435,737 | 4/1969 | Sarka | 493/373 |
| 4,137,829 | 2/1979 | Sarka | 493/342 |
| 4,295,842 | 10/1981 | Bell | 493/342 |

*Primary Examiner*—Frank T. Yost

*Attorney, Agent, or Firm*—Barnes, Kisselle, Raisch, Choate, Whittemore & Hulbert

[57] ABSTRACT

A piece of material cut from a web is removed by a stripper mechanism which is preferably embodied in a pair of die cylinders having coacting cutting blades which cut pieces from a web of material passing between the cylinders. As the cylinders rotate, a piece to be removed is releasably secured to one of the cylinders for rotation therewith, the secured piece is pivoted to lift its leading edge from the die by coaction with a finger on the other die which bears on a trailing portion of the piece. After the piece is carried away by the one die, it is removed by cooperation with a stripper plate which passes between the raised leading edge of the piece and the die and releases and removes the piece from the die.

21 Claims, 10 Drawing Figures

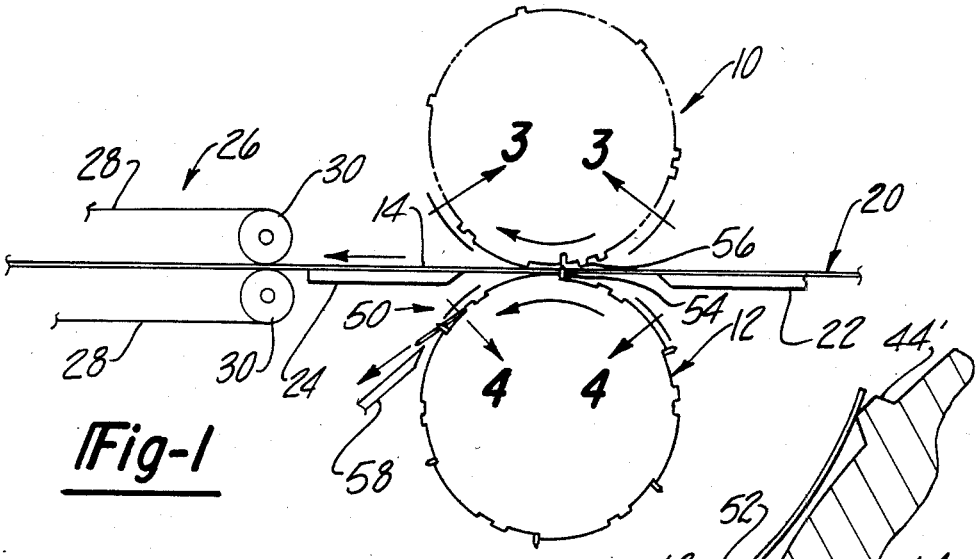
Fig-1
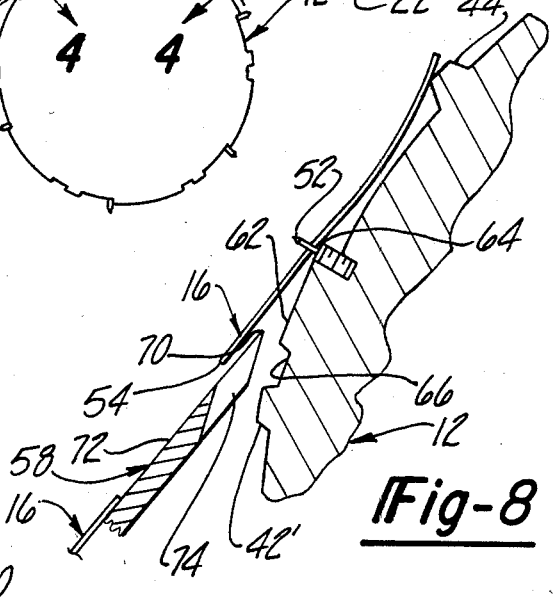
Fig-8
Fig-3
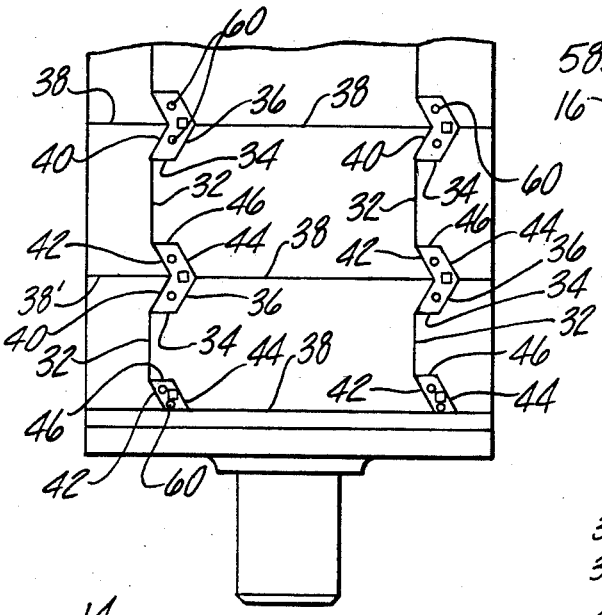
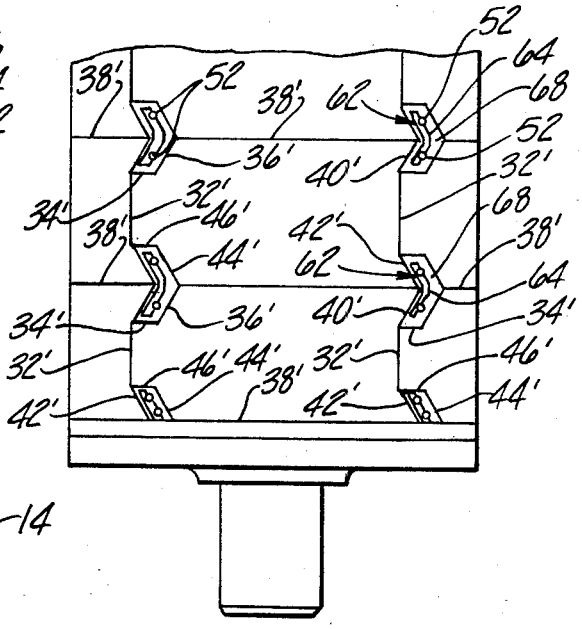
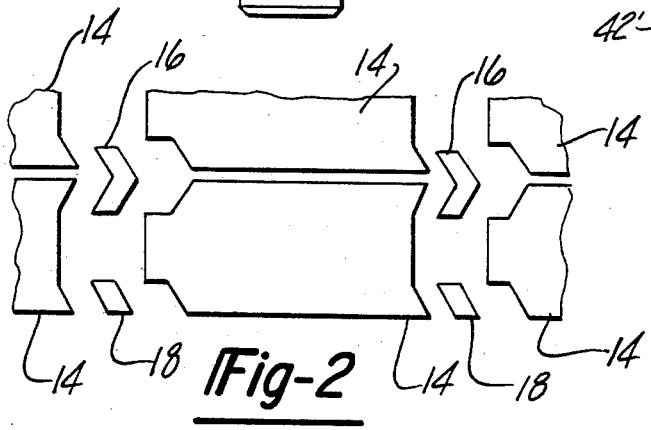
Fig-2
Fig-4

ROTARY STRIPPER

FIELD

This invention relates to rotary die cutting of blanks from thin sheets or webs of material such as paper, paper board, cardboard, plastic film, metal foil, sheet metal, and the like. More particularly, this invention relates to stripping or removing portions from a web of material after they have been cut from the web by the rotary dies.

BACKGROUND

Previously, a web of material was first cut by being passed between a pair of rotary cutting dies having blades which severed or cut portions of the web and then some of the cut portions were removed by passing the cut web between a separate pair of stripping cylinders or rolls at least one of which had a plane cylindrical surface. The cut material to be removed was transferred onto the cylindrical surface, and after the cylinder rotated sufficiently to carry the piece away from the web, it was removed from the cylinder by a stripper plate having a leading sharp edge bearing on the plane cylindrical surface.

This approach has also been utilized directly on a pair of rotary cutting dies where one of the dies had a plane cylindrical surface. To remove cut material the sharp edge directly bore on the cutting die with the plane cylindrical surface. However, if both the cutting dies had severing blades thereon, it would be necessary to utilize a separate pair of stripping cylinders or rolls.

SUMMARY

Pursuant to this invention, a cut portion of a web of material is transferred and releasably secured to a rotating cylinder which does not have a circumferentially continuous plane cylindrical surface, the transferred portion is generally pivoted with respect to the cylinder to move its leading edge generally radially outward from the periphery of the cylinder, and a stripping element such as a slider plate or comb passes between the rotating cylinder and the leading edge of the pivoted portion to remove the portion from the cylinder. Preferably the transferred portion is pivoted about a point or line intermediate its leading and trailing edges by moving a trailing part of the portion into a recess or pocket in the cylinder. Preferably, the trailing part is forced into the pocket by a projection on a second cylinder which corotates with the first cylinder with the web passing between the cylinders. Preferably, the cylinders also have servering blades thereon which cut at least the portions to be removed before they are removed.

Objects, features and advantages of this invention are to provide a stripper mechanism for removing cut portions of a web which can be embodied directly in a pair of rotary cutting dies having coacting severing blades on both dies, unfailingly, reliably, readily and easily removes cut portions, can remove cut portions which are scrap and/or desired parts, is relatively simple, rugged, durable and of economical manufacture and assembly, and require little service or maintenance.

BRIEF DESCRIPTION OF THE DRAWINGS

These and other objects, features and advantages of this invention will be apparent from the following detailed description, appended claims and accompanying drawings in which:

FIG. 1 is a somewhat schematic side view of rotary cutting dies embodying this invention;

FIG. 2 is a fragmentary exploded view of the portions cut from the web by the dies;

FIG. 3 is an enlarged fragmentary view of the upper die cylinder taken generally on line 3—3 of FIG. 1;

FIG. 4 is an enlarged fragmentary view of the lower die cylinder taken generally on line 4—4 of FIG. 1;

FIGS. 5, 6, 7 and 8 are enlarged fragmentary sectional views showing the die cylinders of FIG. 1 in successively advanced stages of rotation;

DETAILED DESCRIPTION

Figure 5:
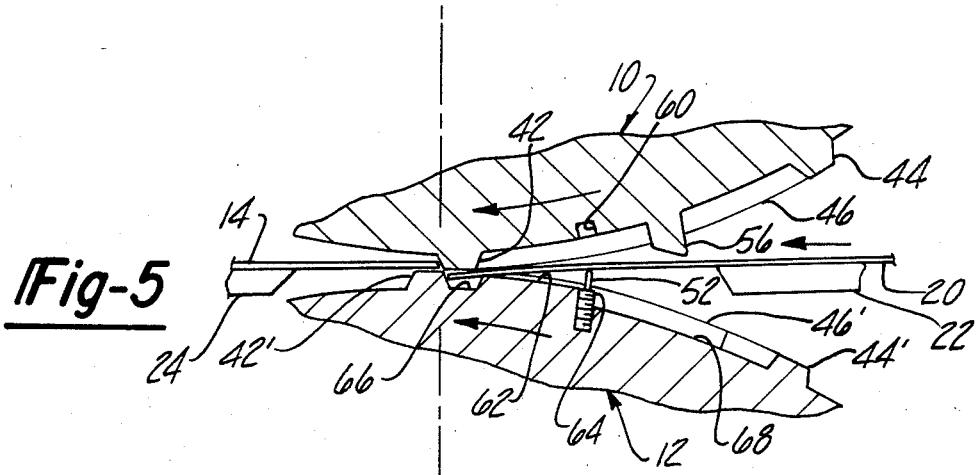

Referring in more detail to the drawings, FIG. 1 illustrates a pair of rotary die cylinders 10 and 12 embodying this invention. When rotating the die cylinders cut elongate parts or blanks 14 and scrap portions 16 and 18 (FIG. 2) from a web of material 20 passing between the cylinders. As the web 20 is fed into the dies, it is supported on a slide plate 22 and as the cut parts 14 emerge from the dies, they are supported by a slide plate 24 and fed into a conveyor assembly 26. In the conveyor 26, the cut parts 14 are received between and carried away by a pair of driven continuous belts or webs 28 each received on an idler pulley 30.

The parts 14 are cut from the web 20 by serving blades disposed on one or both of the die cylinders 10 and 12. Preferably, the blades are constructed and arranged on the cylinders so that multiple parts are cut with each complete revolution of the cylinders. For example, as shown in FIGS. 3 and 4, the blades are arranged on the cylinders 10 and 12 so that they cut three parts 14 across the width of the cylinders and four parts in each path or track around the circumference of the cylinders for a total of twelve parts for each complete revolution of the cylinders.

Figure 6:
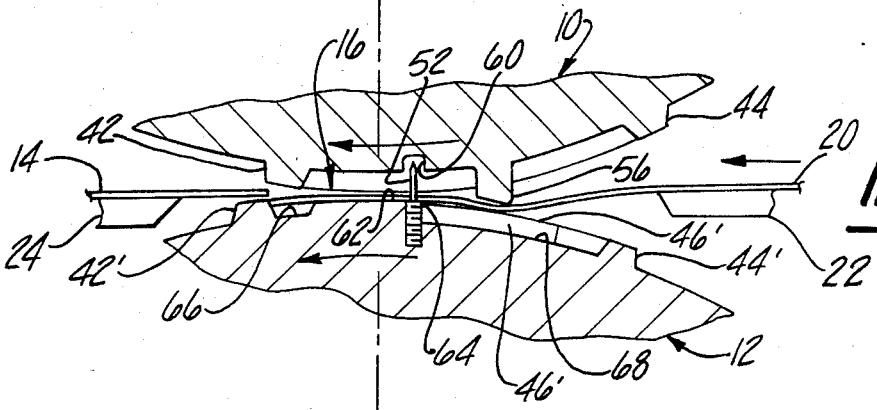
Figure 7:
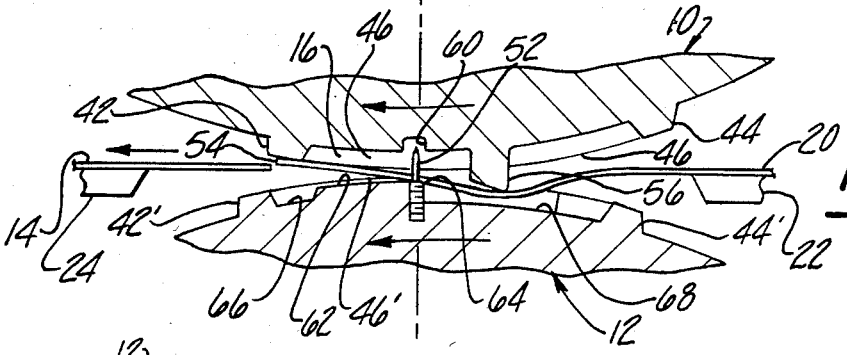

Preferably, the die cylinders 10 and 12 have pairs of coacting elongate severing blades each disposed on one of the die cylinders with their axes on generally opposite sides of the cutting line or line of severance of the web. Thus, as shown in FIGS. 3 and 4, for cutting a part 14, the upper die cylinder 10 has severing blades 32, 34, 38, 40, 42, 44 and 46 which respectively coact with corresponding severing blades of the lower die 32', 34', 36', 38', 40', 42', 44' and 46'. As shown in FIGS. 5–7, the blades of each pair are disposed on opposite sides of the line of severance and preferably each blade is a land disposed on the periphery of its associated cylinder and having in cross section an outer face and spaced apart generally depending side faces defining a part of spaced apart edges. Preferably, the side faces are inclined toward each other at an acute included angle and each inclined to its associated outer face at an obtuse included angle. The blades of each pair are constructed, arranged and positioned on their respective die cylinders such that during corotation of the die cylinders 10 and 12 the immediately adjacent edges of the blades of each pair cut the web therebetween along a predetermined line of severance while the other edges of the blades of each pair are on generally opposite sides of the line of severance.

Preferably, each side face is inclined to its outer face at an obtuse included angle which is usually in the range of about 100° to 120° and preferably about 105° to 110°. Usually the transverse width of the outer face of each land is in the range of about 0.010 to 0.125 of an inch, typically about 0.020 to 0.060 of an inch and preferably about 0.030 to 0.040 of an inch. Usually the radial height of the lands is about 0.050 to 0.125 of an inch and preferably about 0.060 to 0.080 of an inch.

The specific construction, arrangement, and position of the severing blades on the die cylinders is fully disclosed in U.S. patent application Ser. No. 06/589,505 filed on Mar. 14, 1984 and assigned to the assignee of this application, Bernal Rotary Systems, Inc. The disclosure of this U.S. patent application Ser. No. 06/589,505 is incorporated herein by reference and hence, the construction and arrangement of the severing blades will not be described in greater detail herein.

In accordance with this invention, scrap pieces 16 and 18 are removed after being cut from the web by a stripper mechanism 50. The scrap pieces 16 and 18 are removed in the same manner and hence, only the removal of a scrap piece 16 will be described in detail. As shown in FIGS. 1 and 5–8, each piece 16 is releasably secured to the lower die 12 for rotation therewith by at least one pin 52, pivoted so that its leading edge 54 is raised above the lower die 12 by cooperation of a finger 56 on the upper die 10 (FIG. 7), and then removed from the lower die by the cooperation of a comb or stripping plate 58 (FIG. 8).

Preferably, although not necessarily, each piece 16 is secured to the lower die 12 before it is completely cut from the web 20. Each piece is secured by at least one pin 52 piercing the piece. As the dies rotate, each piece 16 is forced over the pins 52 by the cooperation and coaction of the lower die with the upper die 10 which has clearance holes 60 therein for the pins. Typically, pins 52 are about 0.050 to 0.080 of an inch in diameter and holes 60 are about 0.180 to 0.250 of an inch in diameter.

To support and stabilize piece 16 on the lower die 12, the leading portion of the piece is preferably received on a prominence 62 on the lower die, the trailing portion of which provides a line or edge 64 about which the piece 16 is pivoted. Preferably, the pins 52 are threaded into the die 12 immediately adjacent this trailing edge 64. To facilitate forming the severing blades 42 and to provide adequate clearance between the dies for the piece 16, preferably a recess 66 is provided between the prominence and the severing blade. Preferably, although not necessarily, to further insure adequate clearance for the piece 16, the outer face of the prominence 62 lies radially inward of the outer faces of the adjacent severing blades a distance approximately equal to the thickness of the web 20 being cut.

To permit the piece 16 to be pivoted, a recess or pocket 68 is formed in the lower die behind the trailing edge of the prominence to receive a trailing portion of the piece when it is displaced into the pocket by the finger 56. Preferably, but not necessarily, this pocket 68 has a radial depth about equal to the height of the severing blades of the lower cylinder 12. Typically, the prominence 62, pocket 68, and finger 56 are constructed, arranged and dimensioned so that they move the leading edge 54 of the piece away from the cylinder sufficiently to provide a clearance between them which is usually in the range of 0.005 to 0.100 of an inch, typically about 0.010 to 0.050 of an inch and preferably about 0.020 to 0.040 of an inch. To facilitate making the cylinder 10, preferably the fingers are separate pieces secured to the cylinder. Each finger 56 can be a separate piece of rigid material such as steel secured to the cylinder 10 by bolts or the like. Preferably each finger is a separate piece of an elastic or resilient material such as rubber, plastic, elastic, or the like secured to the cylinder by an adhesive or double back adhesive tape. Suitable adhesive tape is available from 3M Company of Minneapolis, Minn. and Morgan Adhesive Company of Stow Ohio.

To remove the pieces 16 from the lower die cylinder, the stripper plate 58 is mounted as shown in FIGS. 1 and 8 angularly downstream from the position at which the pieces are cut from the web. The stripper plate 58 is mounted so that its tip or leading edge 70 passes between the leading edge 54 of the pivoted piece 16 and the lower die cylinder as the piece 16 is advanced toward the stripper plate. As the piece 16 continues to be advanced, it engages the outer face 72 of the stripper plate and then the pins 52 are withdrawn from and disengage the piece as the lower cylinder continues to rotate. Preferably, the stripper plate 58 is positioned so that its outer face 72 is generally tangent to the periphery of the lower die. Preferably, the stripper plate has elongate clearance slots 74 in its leading edge through which the tips of the pins 54 pass as they are advanced by the cylinder. Preferably, the stripper plate is mounted in fixed relation to the lower cylinder with a slight clearance between the stripper plate and the cylinder.

Figure 9:
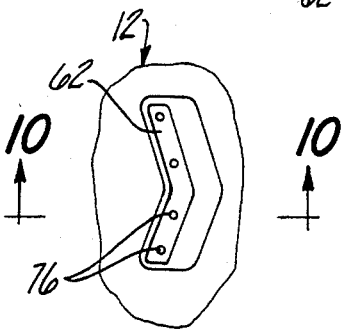
FIG. 9 is a fragmentary plan view of a modification of the lower die cylinder of FIG. 1.
Figure 10:
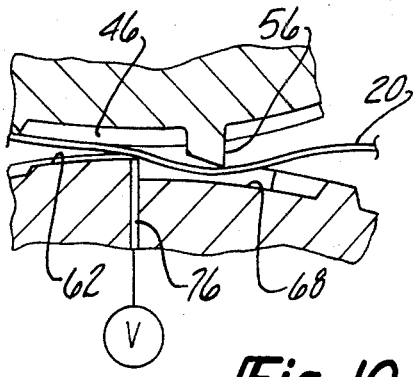
FIG. 10 is a fragmentary sectional view taken generally on line 10—10 of FIG. 9.

FIGS. 9 and 10 illustrate a modification in the way pieces 16 are secured to the lower die 12 so that the pieces can be secured without being pierced or damaged by any pins 52, clamps, or the like. In this modification, vacuum ports 76 open into the upper face of the prominence 62 adjacent its trailing edge 64 and are connected to a source of vacuum 78. These vacuum ports are used in lieu of the pins 52 to releasably secure parts 16 to the lower die cylinder. In all other respects, this modification is identical to the cutting and stripping dies of FIGS. 1–8. Because vacuum ports eliminate piercing or any physical damage to the pieces 16, they are a particularly desirable way of releasably securing pieces which are not scrap but cut parts or blanks to be used in making articles.

When using this invention, dies 10 and 12 are mounted for corotation with a web 20 passing between them as shown in FIG. 1. As the dies rotate in unison with the severing blades moving at the same surface speed and in the same direction when they engage the web 20, the blades cut parts 14 and scrap pieces 16 and 18 from the web. As the dies continue to rotate, parts 14 emerge from the dies, pass over the slide 24 and enter the conveyor 26 which carries them away.

Since each piece of scrap 16 and 18 is removed in the same manner, removal of only one piece of scrap 16 will be described in detail. As will be apparent from a comparison of FIGS. 5 and 6, as each piece of scrap 16 and 18 is being cut from the web, it is releasably secured to the lower die 12 for rotation therewith by being pierced by one or more pins 52. Each pin 52 is forced through a piece of scrap by rotation of the dies which causes the pin 52 and a generally oppose portion of the upper die 10 to move generally radially toward each other with the piece of scrap between them. As the dies continue to rotate, the leading edge 54 of the piece of scrap is lifted and moved away from the lower die by pivoting the piece of scrap (FIG. 7) about the trailing edge 64 of the prominence 62 underlying the piece of scrap. The piece of scrap is pivoted by rotation of the dies which causes the finger 56 of the upper die and the underlying pocket 68 of the lower die to move toward each other with a trailing portion of the piece of scrap between them which is engaged by the finger.

As shown by a comparison of FIGS. 7 and 8, as the dies continue to rotate, the piece of scrap 16 is completely cut or severed from the web 20 and carried by the lower die away from the web and the path of travel of the cut parts 14. As shown in FIG. 8, after the scap is carried away, it is removed from the lower die by the cooperation of the stripper comb or plate 58 and the lower die. As the lower die advances, the sharp edge 70 of the stripper plate passes between the lower die and the raised leading edge 54 of the scrap piece. As the pin 54 passes through the slot 74 in the stripper plate, it is withdrawn from and thereby releases the scrap piece which passes over the upper face 72 of the plate and is thereby removed from the lower die.

While the stripping mechanism 50 has been described as being embodied in a pair of cutting die cylinders, it will be apparent that it can also be embodied in a separate pair of cylinders disposed downstream from a pair of cutting cylinders or other cutting dies and receiving the web after it has been cut.

To facilitate separating parts cut from a web, this stripping mechanism can also be used to cause each row of parts to be directed into separate conveyor systems or to separate every other part in a row of cut parts or to remove parts produced by a single cavity of the cutting dies, and the like. Hence, this stripping mechanism may be used in many applications where it is desirable to remove one or more pieces from a web of cut material.

I claim:

1. A mechanism for removing pieces cut from a web of material comprising: a pair of cylinders of metal constructed and arranged to be journaled for rotation in generally superimposed relation with a web of material passing between them, securing means on one of said cylinders for releasably securing a piece cut from said web to said one cylinder for rotation therewith to carry said cut piece away from said web, at least one finger carried by said other cylinder and constructed and arranged to bear on said cut piece and generally pivotly move the leading edge of said cut piece to a position away and generally radially spaced from the periphery of said one cylinder, and a stripper associated with said one cylinder and having a leading sharp edge adjacent said one cylinder, spaced downstream from the point where the web passes between the cylinders, and constructed and arrange to pass between said one cylinder and said leading edge of said cut piece when radially spaced from said one cylinder and to release and remove said cut piece from said one cylinder as said cut piece passes over said leading sharp edge of said stripper.

2. The mechanism of claim 1 wherein said securing means comprises at least one pin carried by said one cylinder and constructed and arranged to pierce said cut piece when said piece is forced over said pin by the cooperation of a portion of said other cylinder as said cut piece passes between said cylinders.

3. The mechanism of claim 2 which also comprises a pocket in said other cylinder into which said pin pocket as it passes between said cylinders.

4. The mechanism of claim 2 wherein said pin is located on said one cylinder such that it pierces said piece before said piece is completely cut from the web.

5. The mechanism of claim 1 wherein said securing means comprises at least one vacuum port in said one cylinder which is constructed and arranged so that it opens into a peripheral surface of said one cylinder which underlies said piece when said piece passes between said cylinders and is adapted to be connected to a source of vacuum to secure said piece to said one cylinder.

6. The mechanism of claim 5 wherein said vacuum port is also located such that said piece is secured to said one cylinder before it is completely cut from the web.

7. The mechanism of claim 1 wherein said securing means is constructed and arranged such that it secures said piece to said one cylinder before said piece is completely cut from the web.

8. The mechanism of claim 1 which also comprises a recess in said one cylinder which is constructed, arranged and located to underlie a portion of said piece trailing the leading edge thereof such that a portion of said piece while underlying said finger is moved into said recess as said piece passes between said cylinders to thereby pivotly move said leading edge of said piece generally radially away from said one cylinder.

9. The mechanism of claim 8 which also comprises a prominence on said one cylinder which is constructed, arranged and located to underlie a leading portion of said piece when received on said one cylinder, and said prominence has a generally trailing edge adjacent said recess about which said leading edge is pivoted.

10. The mechanism of claim 1 which also comprises a prominence on said one cylinder which is constructed, arranged and located to underlie a leading portion of said piece when received on said one cylinder and having a trailing edge about which said leading edge of said piece is pivoted by said finger on said other cylinder bearing on a portion of said piece to pivot said leading edge of said piece away from said one cylinder.

11. The mechanism of claim 1 which also comprises at least one severing blade on one of said cylinders which is constructed, arranged and located to completely cut said piece from the web as the piece passes between said dies.

12. The mechanism of claim 1 which also comprises at least one pair of coacting severing blades, each of said blades being disposed on one of said cylinders, said blades of each pair being disposed on generally opposite sides of a predetermined line of severance for completely cutting said piece from the web, each severing blade comprising a land projecting generally radially outward from the main body of its associated cylinder, and said securing means being constructed, arranged and located such that it secures said piece to said one cylinder before said piece is completely cut from the web by said coacting severing blades.

13. The mechanism of claim 1 which also comprises at least one pair of coacting severing blades with each blade disposed on one of said cylinders, said blades of each pair being disposed on generally opposite sides of a predetermined line of severance for cutting said piece from the web, each severing blade comprising a land projecting generally radially from the main body of its associated cylinder, each said land having an outer face and spaced apart and generally depending side faces defining a pair of spaced apart edges, at least a portion of said side faces adjacent said outer face of each land of each blade being inclined toward each other at an acute included angle and each inclined to its associated outer face at an obtuse included angle, said coacting severing blades of each pair being constructed, arranged and positioned on their respective cylinders such that during corotation of said pair of cylinders the immediately adjacent edges of said coacting blades of each pair cut the web therebetween along a predetermined line of severance while the other edges of said coacting blades are on generally opposite sides of such line of severance, and said securing means secures said piece to said one cylinder for rotation therewith before said piece is completely cut from the web by said coacting severing blades.

14. A mechanism for removing pieces cut from a web of material comprising: a pair of metal cylinders constructed and arranged to be journaled for rotation in generally superimposed relation with a web of material passing between them, at least one pair of coacting severing blades with each blade disposed on one of said cylinders, said blades of each pair being disposed on generally opposite sides of a predetermined line of severance of a piece from the web, each severing blade comprising a land projecting generally radially outward from the main body of its associated cylinder, each said land having an outer face and spaced apart and generally depending side faces defining a part of spaced apart edges, at least a portion of said side faces adjacent said outer face of each land being inclined toward each other at an acute included angle and each inclined to its associated outer face at an obtuse included angle, said severing blades of each pair being constructed, arranged and positioned on their respective cylinders such that during corotation of said cylinders the immediately adjacent edges of said blades of each pair coact to cut the web therebetween along a predetermined line of severance while the other edges of said severing blades of said pair are on generally opposite sides of such line of severance, securing means carried by one of said cylinders for releasably securing a piece cut from said web by said severing blades to said one cylinder for rotation therewith to carry said cut piece away from said web, at least one projection carried by the other of said cylinders and constructed, arranged and positioned to bear on said piece and generally pivotly move the leading edge of said piece to a position generally radially spaced from said one cylinder, whereby a leading sharp edge of a stripper associated with said cylinder can pass between said cylinder and said leading edge of said piece when radially spaced from said one cylinder and release and remove said piece from said one cylinder as said piece passes over the leading edge of the stripper.

15. The mechanism in claim 14 which also comprises a stripper associated with said one cylinder, generally circumferentially spaced downstream from the point where the web passes between said cylinders, and having a leading sharp edge constructed and arranged to pass between said one cylinder and said leading edge of said piece when radially spaced from said one cylinder to release and remove said piece as it passes over said leading edge of said stripper.

16. The mechanism of claim 14 wherein said securing means is constructed, arranged and positioned on said one cylinder to secure said piece thereto before it is completely cut from the web by said severing blades.

17. The mechanism of claim 14 which also comprises a prominence carried by said one cylinder and constructed, arranged and positioned to underlie a leading portion of said piece when secured to said one cylinder, said prominence having a trailing edge about which said leading edge of said piece is pivoted, and a recess in said one cylinder trailing said prominence, disposed adjacent said trailing edge of said prominence, and constructed and arranged to receive a trailing portion of said piece when moved into said recess by the cooperation of said one cylinder and said projection on said other cylinder.

18. A method of removing pieces cut from a web of material comprising: corotating a pair of cylinders of metal in generally superimposed relation to pass a web of material between them, transferring to one of the cylinders a piece of material cut from the web, releasably securing such piece of material to the one cylinder for rotation therewith to carry such cut piece away from the web, moving the leading edge of such cut piece generally radially away from such one cylinder while such one piece is retained thereon, and, after such cut piece has been moved away from such web by rotation of such one cylinder and the leading edge of such one piece has been moved away from such one cylinder, removing such piece from such one cylinder and moving such one piece along a path generally tangential to the outer periphery of such one cylinder, whereby such piece is separated and removed from the web and the path of travel of the web.

19. The method of claim 18 which also comprises cutting the piece from the web as it passes between the cylinders by the coaction of at least one pair of severing blades having one severing blade on each of the cylinders.

20. The method of claim 19 which also comprises securing such piece to the one cylinder before it is completely cut from the web by the severing blades.

21. The method of claim 17 wherein the leading edge of such piece is pivoted to move it generally radially away from the one cylinder by the cooperation of the one cylinder with a projection on the other cylinder which bears on a portion of such piece trailing its leading edge when such piece passes between the cylinders.

* * * * *

UNITED STATES PATENT AND TRADEMARK OFFICE

CERTIFICATE OF CORRECTION

PATENT NO. : 4,561,334

DATED : Dec. 31, 1985

INVENTOR(S) : Albert J. Sarka

It is certified that error appears in the above—identified patent and that said Letters Patent is hereby corrected as shown below:

At claim 1, Column 5, line 54, delete "arrange" and insert -- arranged --

At claim 3, column 5, line 67, in the second instance, delete "pocket" and insert -- projects --

Signed and Sealed this

Twenty-fifth Day of March 1986

[SEAL]

*Attest:*

*Attesting Officer*

DONALD J. QUIGG

*Commissioner of Patents and Trademarks*